US010022014B2

(12) United States Patent
Mateos Martin et al.

(10) Patent No.: US 10,022,014 B2
(45) Date of Patent: Jul. 17, 2018

(54) GAS COOKING APPLIANCE

(71) Applicant: COPRECITEC, S.L., Aretxabaleta (ES)

(72) Inventors: Ruben Mateos Martin, Marietta, GA (US); Joseba Jokin Antxia Uribeetxebarria, Aretxabaleta (ES); Aitor Zabalo Bayon, Arrasate (ES)

(73) Assignee: COPRECI, S. COOP., Aretxbaleta (ES)

( * ) Notice: Subject to any disclaimer, the term of this patent is extended or adjusted under 35 U.S.C. 154(b) by 291 days.

(21) Appl. No.: 14/072,031

(22) Filed: Nov. 5, 2013

(65) Prior Publication Data

US 2014/0165849 A1 Jun. 19, 2014

(30) Foreign Application Priority Data

Dec. 13, 2012 (ES) ..... 201231936

(51) Int. Cl.

| | |
|---|---|
| ***F23D 5/12*** | (2006.01) |
| ***A47J 36/32*** | (2006.01) |
| ***F23N 5/24*** | (2006.01) |
| ***F24C 3/12*** | (2006.01) |

(52) U.S. Cl.

CPC ..... *A47J 36/32* (2013.01); *F23N 5/242* (2013.01); *F24C 3/124* (2013.01)

(58) Field of Classification Search

CPC ..... A47J 36/32; F23N 5/242; F23N 3/124; F23N 2027/16; F23N 2029/00; F23N 5/102; F23N 5/245; F23N 5/203; F23N 2031/22; F23N 2041/08; F23C 3/124; F23D 5/16

USPC ..... 99/342, 344, 343, 325–328, 329 R, 337, 99/338, 341; 431/14–17, 22, 24, 25, 13;

(Continued)

(56) References Cited

U.S. PATENT DOCUMENTS

| | | | |
|---|---|---|---|
| 4,130,104 | A | 12/1978 | Kristen et al. |
| 5,791,890 | A | 8/1998 | Maughan |
| 6,087,944 | A | 7/2000 | Santacatterina |

(Continued)

FOREIGN PATENT DOCUMENTS

| | | | |
|---|---|---|---|
| DE | 2500557 | A1 | 7/1976 |
| EP | 0715126 | A1 | 6/1996 |

(Continued)

OTHER PUBLICATIONS

International Search Report (ISR) and Written Opinion (ISA), International Application No. PCT/EP2013/071094 International Filing Date Oct. 9, 2013, dated Feb. 28, 2014, 11 pages, European Patent Office, Rijswijk Netherlands.

*Primary Examiner* — Michael G Hoang

(74) *Attorney, Agent, or Firm* — Edell, Shapiro & Finnan, LLC

(57) ABSTRACT

A gas cooking appliance having a gas burner, at least one control device comprising a gas regulating valve regulating the flow of gas to the gas burner, a knob controlling the opening ON and closing OFF of the valve, and a position sensor detecting the ON-OFF position of the knob, and at least one signaling device comprising a light signal source that emits an alarm signal in the form of light. The light signal source emits the alarm signal during a time period T1 when the position sensor detects that the knob is in the OFF position, after the knob having been in the ON position, and the gas burner has been switched on at least during a time period T2.

10 Claims, 4 Drawing Sheets

(58) Field of Classification Search
USPC ..... 362/23.08, 23.1; 126/42; 219/445.1, 219/448.1, 448.17; 340/577, 579, 588
See application file for complete search history.

(56) References Cited

U.S. PATENT DOCUMENTS

| | | | | |
|---|---|---|---|---|
| 7,913,614 | B2 * | 3/2011 | Fukushima | A47J 31/4485 134/22.11 |
| 8,429,827 | B1 * | 4/2013 | Wetzel | A47J 43/283 294/55.5 |
| 2002/0113057 | A1 | 8/2002 | Lerner | |
| 2010/0216080 | A1 * | 8/2010 | Home | F24C 3/126 431/13 |
| 2011/0146650 | A1 | 6/2011 | Karamatic et al. | |
| 2014/0165849 | A1 | 6/2014 | Mateos Martin et al. | |

FOREIGN PATENT DOCUMENTS

| | | | |
|---|---|---|---|
| EP | 859192 | A1 | 8/1998 |
| EP | 1818618 | A2 | 8/2007 |
| GB | 2219115 | A | 11/1989 |
| WO | WO2007102072 | A2 | 9/2007 |
| WO | WO2012089556 | A2 | 7/2012 |

* cited by examiner

GAS COOKING APPLIANCE

CROSS-REFERENCE TO RELATED APPLICATIONS

This application relates to and claims the benefit and priority to Spanish Patent Application No. P201231936, filed Dec. 13, 2012.

TECHNICAL FIELD

The present invention is related to a gas cooking appliance.

BACKGROUND

Gas cooking appliances, particularly barbecues, with at least one signaling device that allows emitting an alarm signal warning the user when the flame of any of the gas burners of the cooking appliance has accidentally gone out, are known in the prior art.

EP1818618 A2 discloses a gas cooking appliance with at least one gas burner, at least one control device comprising a gas regulating valve regulating the gas burner, a knob controlling the opening ON and closing OFF of the valve, and a position sensor detecting the ON-OFF position of the knob, and at least one signaling device comprising a light signal source that emits an alarm signal when the knob is in the ON position and the flame of the at least one gas burner has gone out.

SUMMARY OF THE DISCLOSURE

According to some implementations a gas cooking appliance is provided that comprises at least one gas burner, at least one control device comprising a gas regulating valve regulating the at least one gas burner, a knob controlling the opening ON and closing OFF of the gas regulating valve, and a position sensor detecting the ON-OFF position of the knob. The gas cooking appliance also comprises at least one signaling device associated with each control device which in turn comprises a light signal source that can emit an alarm signal in the form of light. The light signal source emits the alarm signal during a time T1 when the position sensor detects that the knob is in the OFF position, after the knob having been in an ON position, and the burner has been switched on at least during a time T2. This allows notifying the user by means of the alarm signal that there is a potential personal safety problem, despite having closed and arranged the knob controlling the gas regulating valve, and therefore regulating the gas burner, in the closed OFF position. This is because after having been using the gas cooking appliance, and therefore having had at least one gas burner switched on during a time T2, the gas burner and its surrounding area are hot and can cause burns. To avoid the problem and after having arranged the knob controlling the gas burner in the OFF position, the light signal source of the signaling device of the gas cooking appliance emits an alarm signal during a time T1. During that time T1 the alarm signal warns the user that there is a possible safety problem which allows the user to take the appropriate precautionary measures.

This alarm signal may be obtained without using temperature sensors added to the gas cooking appliance, which entails a lower cost of the gas cooking appliance.

These and other advantages and features will become evident in view of the drawings and the detailed description.

DETAILED DESCRIPTION

A user that is using a gas cooking appliance, particularly a barbecue in an open space, is exposed to a series of possible risks. The possible risks can be, for example, that due to daylight it is impossible to see whether or not the gas burner or burners that are switched on maintain the flame, either because the bottom of the cooking pot above the burner is big, or because the sunlight prevents seeing the flame. There is also the possible risk that the flame of any of the burners that are on, i.e., with the knob controlling the gas regulating valve in an open ON position, accidentally goes out, and the user does not see it. It is also possible that the gas supply has run out without the user knowing it.

Another possible risk for the user occurs when after having had any of the burners on, the user closes the corresponding knob to the OFF position and wants to handle the burner, its surrounding area, or any of the parts of the surrounding area, (such as the grill supporting the cooking pots) which are capable of causing burns. It would be suitable for the user to be able to be warned about the risk so that he/she can take the appropriate precautionary measures. In this regard a gas cooking appliance, particularly a barbecue, having a signaling device that emits an alarm signal when that possible type of risk arises is advantageous.

Figure 1:
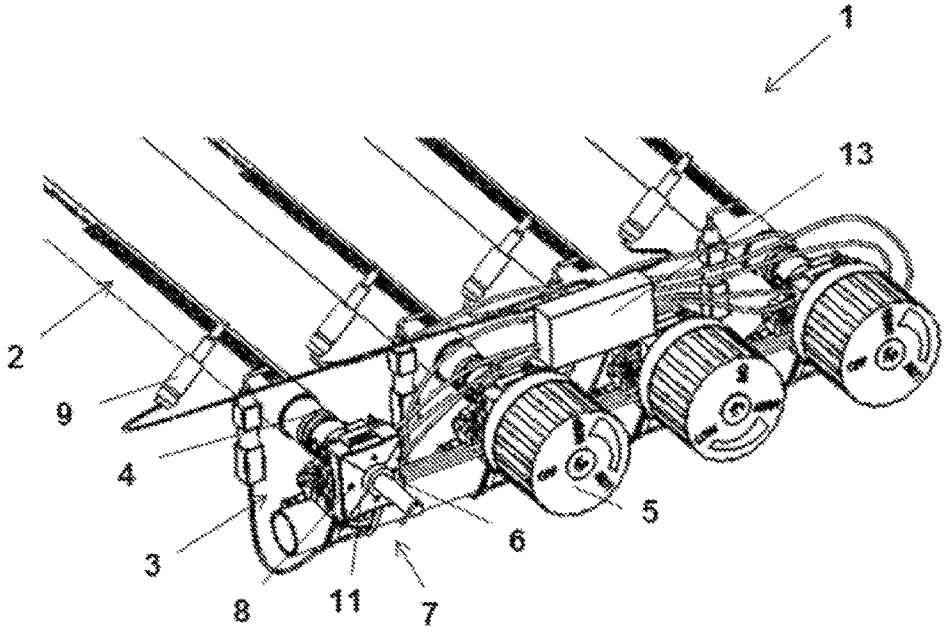
FIG. 1 shows a partial front perspective view of a gas cooking appliance according to one implementation, the appliance being shown without the control panel.
Figure 1A:
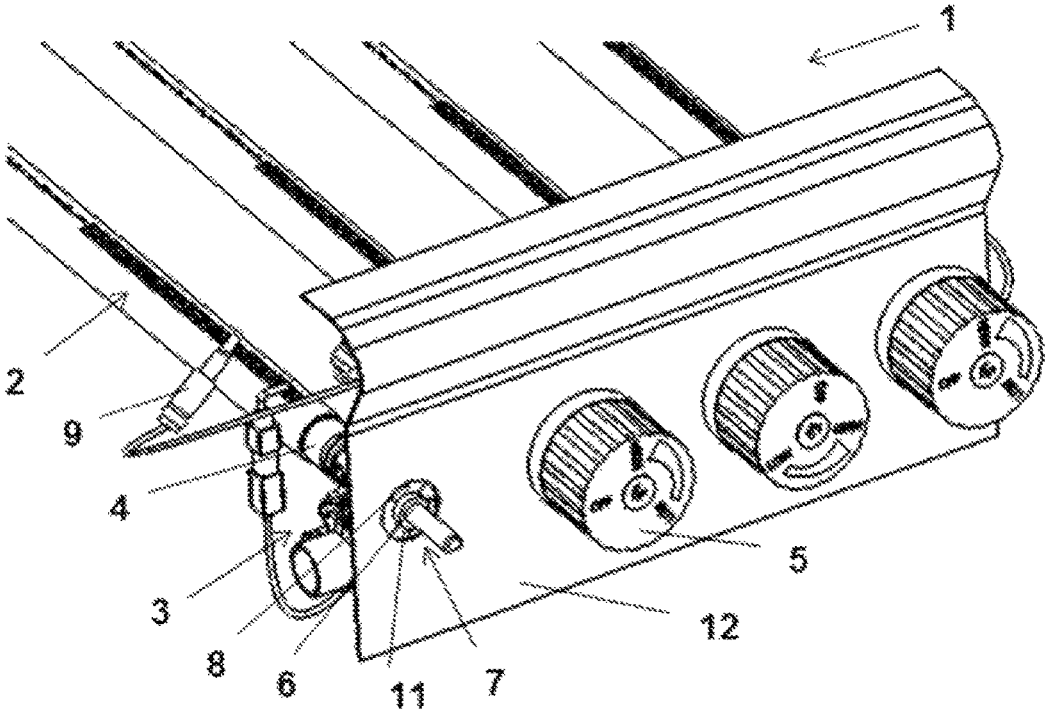
FIG. 1*a* shows a partial front perspective view of the gas cooking appliance of FIG. 1 with the control panel.

FIG. 1 shows a partial front perspective view of a gas cooking appliance 1 according to one implementation, the appliance being shown without the control panel. FIG. 1*a* shows a partial front perspective view of the gas cooking appliance 1 of FIG. 1 with the control panel.

Gas cooking appliance 1 comprises a plurality of gas burners 2, each of which comprises a control device 3. The control device 3 in turn comprises a gas regulating valve 4 regulating the gas inlet of the gas burner 2, a knob 5 controlling the opening ON and closing OFF of the gas regulating valve 4, and a position sensor 6 detecting the ON-OFF position of the knob 5. Each gas regulating valve 4 is connected on one hand to the centralized gas supply, and on the other hand it is connected with the gas burner 2. The gas regulating valve 4 comprises a valve body and a shaft connected with the valve body at one end and projecting away from the valve body at the other end. Each knob 5 is connected with the outwardly projecting end of the shaft, and it allows turning the valve body controlling with the turn the opening of the gas regulating valve 4, arranging it in an ON position, or in the closing OFF position. The supply of gas to the gas burner 2 is thus regulated.

Figure 2:
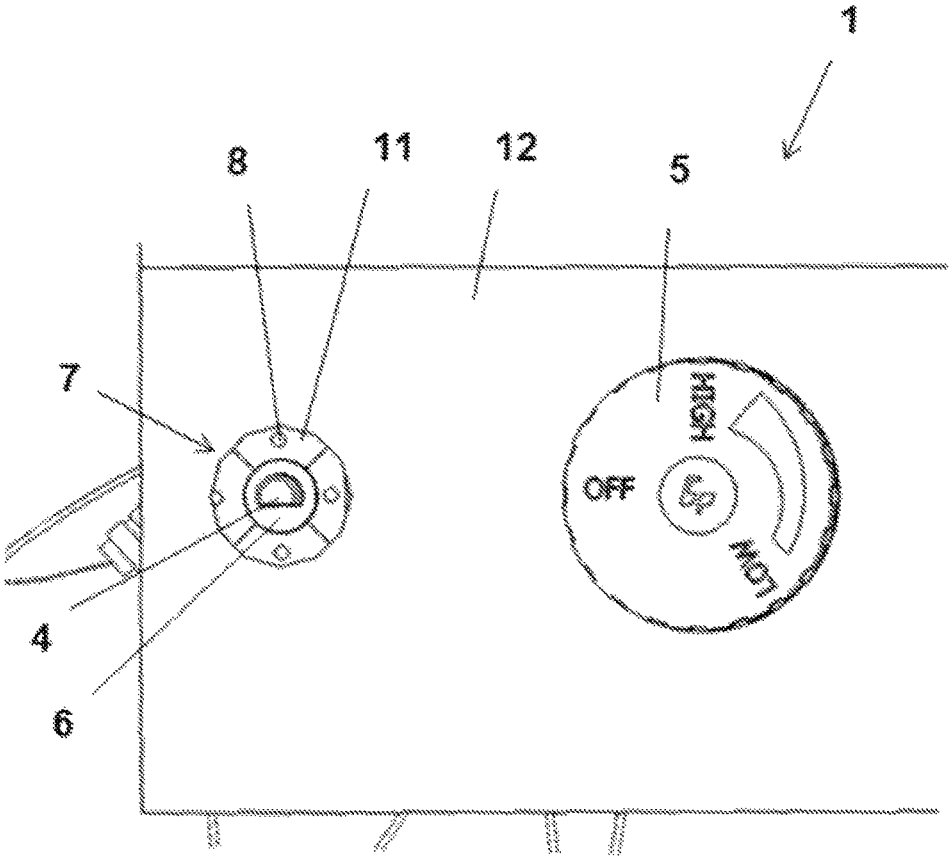
FIG. 2 shows a detailed partial front view of the gas cooking appliance of FIG. 1*a* with two control devices, one being shown with a knob and the other being shown without a knob.

FIG. 2 shows a detailed partial front view of the gas cooking appliance 1 of FIG. 1*a* with two control devices 3, one with a knob 5 and the other being shown without a knob 5. The gas cooking appliance 1 comprises one signaling device 7 for each gas burner 2, although there can also be embodiments of gas cooking appliances with one or more than one signaling device 7. This signaling device 7 comprises a light signal source 8. This light signal source 8 emits, under certain conditions explained below, an alarm signal in the form of light that notifies the user of a risk situation. When the user has been using any of the burners 2 of the gas cooking appliance 1 during a time T2 in which it is switched on and subsequently turns the gas burner 2 off by moving the knob 5 from an opening ON position to the closing OFF position, the supply of gas to the gas burner 2 is closed and the flame goes out. If the user wants to handle the burner or the grill supporting the cooking pots, for example to clean them, there is a risk during a time after the control knob has been returned to the OFF position that a user may burn his/her hands. To warn the user that there is a risk situation the gas cooking appliance 1 allows the signaling device 7, connected with control means of the gas cooking appliance 1 (not shown in the drawings), to activate the light signal source 8 corresponding to the gas burners 2, that have been switched on, and to emit the alarm signal. The control means may be arranged, for example, in a centralized control module 13 or in an individual control module 13 for each control device 3.

The alarm signal of the light signal source 8 is emitted during a time T1 which has been estimated to be sufficient for reaching a sufficient temperature of the heated parts to be handled risk-free. The time T1 during which the alarm signal is emitted is calculated in each case in relation to the time T2 during which time each gas burner 2 has been switched on. This relationship between times T1 and T2 is the result of experimentation, the value of time T2 from which the temperature of the parts affected by the gas burner 2 being switched on, reaches a value that cannot be handled by the user without protection first being determined. After that threshold value of time T2, and as the time increases, the temperature reached is higher, and the time T1 during which the alarm signal is emitted also increases. These related times are recorded in a table which is included as a parameter table in memory means comprised in the gas cooking appliance 1 (not shown in the drawings) and arranged in the centralized control module 13. According to some implementations a control means is arranged in the centralized control module 13 and is connected with the memory means.

In the gas cooking appliance 1 shown in FIGS. 1 and 1*a* each control device 3 of the gas cooking appliance 1 comprises a flame sensor 9 which serves for detecting the presence of a flame corresponding to the gas burner 2. According to some implementations the flame sensor 9 is an ionization sensor with an electrode close to the flame that generates a signal that is sent to comparison means situated in the gas cooking appliance 1 (not shown in the drawings), where it is compared with a reference value. The comparison means may be arranged in the centralized control module 13. The flame sensor 9 and the comparison means, and the comparison means and the control means being operably connected. The flame sensor 9 is preferably a sensor with high sensitivity for detecting the presence or absence of flame in the burner, the sending of the activation or deactivation signal being virtually immediate. According to some implementations the flame sensor 9 is assembled close to a spark plug. In such an implementation the spark plug may be connected to a centralized spark generator that is arranged in the centralized control module 13 and controlled through an ignition switch (not shown in the drawings). In such an implementation the ignition switch may be arranged in the signaling device 7. The ignition switch may be coupled to the shaft of the gas regulating valve 4 such that when the user opens the valve 4 by moving the knob 5 to an ON position, to allow the gas passage towards the burner 2, electrical contact occurs in the ignition switch and the spark generator generates sparks in the spark plug.

The user can thus switch on the gas burner 2 in which he/she wants to generate a flame. Another type of flame sensor 9 is a thermocouple, which is a transducer formed by the attachment of two different metals, producing a voltage that is the function of the temperature difference between the hot attachment and the cold attachment or reference point. It does not reach the level of sensitivity and speed in the sending of the electrical signal from the ionization sensors. If a thermocouple is used to detect the presence of flame, the response is slower because it needs more time to detect the variations that may occur with the flame.

In normal barbecue operation, when the user has decided which gas burners 2 to use, he/she opens the corresponding gas regulating valves 4 to an ON position with the aid of the knobs 5, and the gas flows towards the respective gas burner, sparks being generated in the spark plugs. The flame is generated with the spark as the gas is delivered to the respective gas burner 2. In the implementation of the gas appliance 1 shown in FIGS. 1 and 1*a* the position sensor 6 detects an ON position of the knob 5 and sends a signal to the control means of the gas cooking appliance 1. The flame sensor 9 in turn detects the presence of flame in the gas burner 2 and sends a signal to the comparison means of the gas cooking appliance 1. The comparison means sends a signal to the control means of the gas cooking appliance 1, depending on the value resulting from the comparison with the reference value. In such an implementation the control means, comparison means and memory means of the gas cooking appliance 1 may be grouped in a single centralized control module 13.

When signals from the position sensor 6 and from the comparison means are received in the control means, the control means sends a resulting signal to the signaling device 7 which activates the light signal source 8 that results in the emission of an operating signal, the operating signal being indicative that the gas burner 2 is generating a flame and operating normally. When a flame ionization sensor is used, the operating signal is produced virtually immediate from the time the flame has been produced in the corresponding burner. The response time will depend to a greater extent on the time the burner has been switched on since the knob 5 has been put in an ON position. To a lesser extent it will depend on the response time of the centralized control module 13.

According to one implementation the operating signal is a blue light, for example, that is emitted continuously while the gas burner 2 is switched on. In another implementation the operating signal is a blue light emitted intermittently, which may better attract the user's attention. In another implementation the operating signal may be a blue light varying in intensity in time intervals, such as, for example, from lower intensity to a higher intensity.

According to some implementations in order to notify the user that he/she has opened a gas regulating valve 4 to an ON position with the knob 5 and that a flame in the gas burner 2 has not been detected, the state of the operating signal can be different, using an intermittent blue light, for example, until receiving the signal from the flame sensor 9, the light then being a continuous blue light. Different combinations can thus be generated for the purpose of notifying the user that the flame has not been produced when the regulating valve 4 is in an ON position.

When the user switches off the gas burner or burners 2 that have been switched on, he/she arranges the knob 5 in the OFF position, and the supply of gas to the gas burner 2 is thus cut off and the flame goes out. In this position the position sensor 6 sends a signal to the control means. The flame sensor 9 which was sending a signal to the comparison means, because the gas burner 2 was switched on and had a flame, in turn detects the absence of flame in the gas burner 2 and stops sending the signal to the comparison means. The comparison means compare this lack of signal with the reference value and stops sending a signal to the control means. When the centralized control module 13 receives the OFF position signal of the knob 5, and the lack of signal from the flame sensor 9, it takes into account the time T in which the gas burner 2 has been on and then accesses the memory means. In the memory means, time T is compared with threshold time T2 in which it is considered that the parts in the surrounding area of the burner 2 are at a temperature of risk for the user. If time T is greater than threshold time T2, it locates time T1 corresponding to the time T in the memory means and sends a signal to the signaling device 7 to activate the light signal source 8 and emits the alarm signal. This alarm signal will be emitted during time T1. The alarm signal is virtually immediate from the time in which the knob 5 is placed in the OFF position, because the detection of a lack of flame by the ionization sensor is immediate.

According to some implementations the alarm signal is a red light that may be emitted continuously while the knob 5 of the gas burner 2 is in the OFF position and during time T1.

Another situation occurs when any of the gas burners 2 is switched on, i.e., it has a flame, and therefore with the corresponding knob in an ON position, the flame accidentally goes out for example either due to a gust of wind or as a result of the gas having run out, etc. These situations are of risk for the user because in the first situation, for example, the gas is still being supplied with the possible subsequent risk of an explosion, and in the second situation the user thinks that the gas burner 2 is still on and this is not the case. In these situations, the position sensor 6 continues to send an ON position signal to the control means. The flame sensor 9 that was sending a signal to the comparison means, because the gas burner 2 was switched on and had a flame, in turn detects the absence of flame in the gas burner 2 and stops sending the signal to the comparison means. The comparison means compares this lack of signal with the reference value and stops sending a signal to the control means. When the centralized control module 13 receives the ON position signal of the knob 5 and the lack of signal from the flame sensor 9, it takes into account the time T in which the gas burner 2 has been on and the control means sends a signal to the signaling device 7, which activates the signal source 8 by emitting an alarm signal. To distinguish the alarm signal of a situation in which the user has deliberately switched off the gas burner 2 from a situation in which the flame of a gas burner 2 has accidentally been extinguished, the alarm signal may be an intermittent red light indicating to a user a situation of greater urgency and risk.

In response to the alarm signal indicating an accidental extinguishing of a flame, the user may close the knob 5 by placing it in the OFF position, whereby the supply of gas to the gas burner 2 is cut off. The continued existence of an added risk continues to be evaluated, and after the centralized control module 13 receives the OFF position signal of the knob 5, and the lack of signal from the flame sensor 9 continues, the memory means of the centralized control module 13 is accessed where time T is compared with threshold time T2. If time T is higher than T2, time T1 corresponding to the time T is located in the memory means and a signal is sent to the signaling device 7, which in turn activates the signal source 8 causing it to emit an alarm signal in the form of light. This alarm signal may be a red light which may be emitted continuously during a time T1 to indicate that there is residual heat in the parts of the surrounding area of the gas burner 2. It is distinguished from the alarm signal with an intermittent red light that indicates the flame has gone out with the knob 5 in an ON position.

If there is an accidental extinguishing of the flame to a burner the alarm signal may emit an intermittent red light, and if the user has immediately realized this and has reacted by putting the knob 5 in the OFF position, the alarm signal becomes a continuous red light if time T was greater than threshold time T2 and is emitted during a time T1. If from the time the alarm signal indicating the accidental extinguishing of the flame the user has belatedly realized this, when he/she arranges the knob 5 in the OFF position the alarm signal goes from emitting an intermittent red light to emitting a continuous red light provided that time T1 corresponding to it for emitting the alarm is greater than the time lapsing from the time the gas burner 2 has been switched off. If the user still does not realize that the flame has gone out, there will come a time when the time lapsing from when the burner 2 has been switched off is greater than the time T1 corresponding to it for emitting the continuous red light, and the alarm signal continues by emitting an intermittent red light until the user places the knob 5 in the OFF position, and the alarm signal is no longer emitted.

According to other implementations the alarm signal may be a light varying in intensity in time intervals, from low intensity to higher intensity, or vice versa. It is important to differ the type of alarm signal from when the knob 5 is in the ON position, and the flame goes out accidentally, from when the knob 5 is arranged in the OFF position and it is deliberately switched off. This difference can be made with the continuity or intensity of the light. Likewise, the color of the light distinguishes the operating signal (blue) from the alarm signal (red), but other colors could be used.

Figure 3:
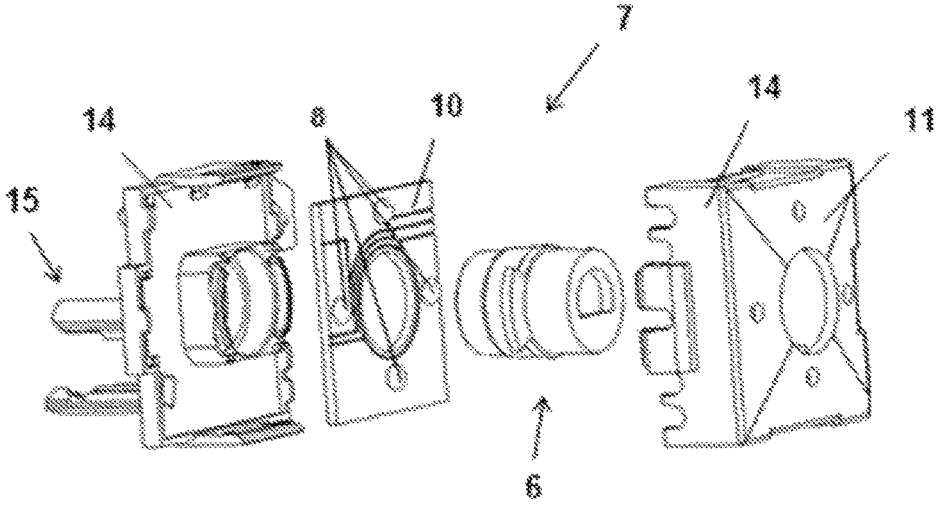
FIG. 3 shows an exploded front perspective view of the signaling device of the gas cooking appliance of FIG. 1.
Figure 3A:
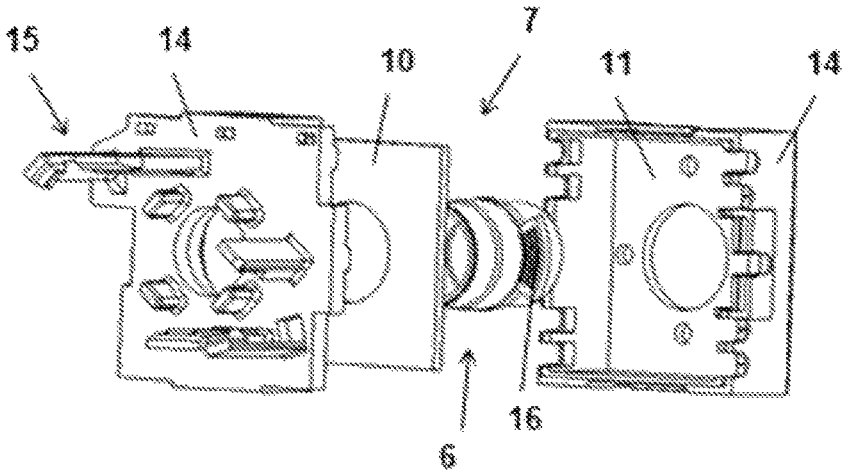
FIG. 3*a* shows an exploded rear perspective view of the signaling device of the gas cooking appliance of FIG. 1.

FIG. 3 shows an exploded front perspective view of the signaling device of the gas cooking appliance 1 of FIG. 1. The signaling device 7 comprises a box-shaped body 14 in which there is arranged a printed circuit board 10. The printed circuit board 10 comprises the printed electrical circuits that allow transmitting the signals coming from the centralized control module 13 to the light signal source 8, allowing the operating or alarm signals to be emitted, as well as transmitting signals coming from the ignition switch to the centralized control module 13, where the spark generator is arranged, and thus putting the spark plug into operation.

In the implementation shown in FIGS. 1 and 1*a*, the signaling device 7 of the gas cooking appliance 1 is arranged between each gas regulating valve 4 and the knob 5 corresponding to the valve 4. To that end, the signaling device 7 comprises a support 15 outside the body 14 that allows attaching the device 7 to the gas regulating valve 4 in the valve body, the body 14 having a hole going through it and allowing the passage of the shaft of the valve 4. The printed circuit board 10 in which the light signal source 8 is supported also comprises a hole that allows the passage of the shaft. In this implementation the position sensor 6 of the control device 3 is arranged inside the body of the signaling device 7 and in contact with the printed circuit board 10 when the signaling device 7 is assembled. The position sensor 6 may be a substantially cylindrical element preferably made of plastic that has a hole in the center, having elements for the external fitting with the signaling device 7, and an element for internal fitting that allow it to be coupled with the shaft of the valve 4. Therefore when the shaft of the valve 4 is turned, it integrally turns the position sensor 6, the signaling device 7 remaining fixed. The signaling device 7 can thus be arranged between the gas regulating valve 4 and the knob 5, introducing it on the shaft of the valve 4 through the holes of the body 14, the position sensor 6, and the printed circuit board 10. Once introduced on the shaft, the signaling device 7 is fixed to the valve 4 by means of the support 15 outside the body 14, the shaft of the valve 4 being fitted to signaling device 7 by means of the inner fitting element of the position sensor 6.

The position sensor 6 comprises electrical circuit terminals that can be placed in contact with electrical terminals of the printed circuits of the printed circuit board 10. The position of the terminals of the position sensor 6 corresponds with ON and OFF positions of the knob 5, such that when it corresponds with an ON position it activates part of the printed circuits of the board 10, and when it corresponds with the OFF position it activates another part of the printed circuits of the board 10. Therefore in each ON-OFF position a different electrical circuit is activated, and in each case a signal can be received from the centralized control module 13 of the gas cooking appliance 1.

According to some implementations (not shown in the drawings) the position sensor 6 is arranged outside the signaling device 7, linked with the printed circuit board 10, and can have different configurations. For example, it can be configured as an element with a shape such that by turning the knob 5 between the ON-OFF positions, it forces the position sensor 6 to be positioned in one of two states in each of which a different electrical circuit is closed.

The light signal source 8 of the signaling device 7 emits different types of signals when activated. FIG. 2 shows a view of the signaling device 7 of the gas cooking appliance 1 of FIG. 1, where the signaling device 7 also comprises a light guide 11. FIG. 3 shows a front partial view of the gas cooking appliance 1 of FIG. 1 without the panel, and the control devices 3 without knobs 5, and FIG. 4 shows a detailed partial front view of the gas cooking appliance 1 of FIG. 1 with the panel, with two control devices 3, one with a knob 5 and the other shown without a knob 5.

According to some implementations the light signal source 8 is arranged in the printed circuit board 10. The light signal source 8 may comprise four light emitters arranged in the vertical and horizontal axes of the printed circuit board 10 when it is assembled. The printed circuit board 10 allows the electrical connection of the light signal source 8 with the electrical circuits of the printed circuit board 10. In such an implementation, a light guide 11 may be provided that includes a board supported in the body 14 of the signaling device 7. The board of the light guide 11 is made of a material that is opaque to light transmission having four holes, some of which are arranged in the vertical axis and others arranged in the horizontal axis. The holes allow the four light emitters of the light signal source 8 to emerge from the surface of the board of the light guide 11, allowing the guiding thereof. Therefore there is an optical connection between the light signal source 8 and the light guide 11, this guide 11 allowing the diffusion of the signals emitted by the light signal source 8 through the board of the light guide 11, the opacity of the material preventing the diffusion in other directions.

The light guide 11 with this configuration is arranged between the printed circuit board 10 and the knob 5 of the control devices 3 such that the signals emitted by the light signal source 8 can be led to the knob 5. The light signals reach the knob 5 according to the shape of the board of the light guide 11. In the implementation of FIGS. 1*a* and 2, the gas cooking appliance 1 comprises a control panel 12 on the inner face of which the signaling devices 7 are supported, the panel 12 having holes that allow the projection of the shafts of the gas valves 4. The shafts of the valves 4 go through the control panel 12, allowing the coupling of the knobs 5 at the ends of the shafts in the outer face of the control panel 12. The holes of the panel 12 further allow seeing the lighting guides 11, the knobs 5 covering the holes and the lighting guides 11. Since the material of the knobs 5 is a material that allows light diffusion, the operating and alarm signals can be seen from the outside when the light signal source 8 is activated, the knobs 5 being shown lighted up.

Light effects of the knob 5 itself are achieved partially or completely, depending on the shape that is given to the light guide 11 and/or the opacity of the knobs 5, always allowing the emission of the alarm and operating signals in the different manners mentioned above. The light emitters of the light signal source 8 that emit the operating signal may be arranged in the horizontal axis of the light guide 11 when it is assembled. The light emitters of the light signal source 8 that emit the alarm signal may be arranged in the vertical axis of the light guide 11 when it is assembled.

According to some implementations (not shown in the drawings), light signals partially lighting up the contour of the knobs can be achieved. In such implementations each signaling device 7 may be arranged supported on the rear part of the panel 12, with the light guide 11 in the area surrounding the holes that give passage to the shafts of the gas regulating valves 4 in the control panel 12. In the panel 12, with the light guide 11 in an area surrounding knobs 5 on the outside, the material of the panel 12 is a material that allows light diffusion. The light guide 11 is fitted in the rear part of the panel 12 in the area of the panel 12 with translucent material, such that when the light signal source 8 emits any type of signal, these signals light up the panel 12 along the contour of the knob 5 that has been defined with the light guide 11. In a variant of this (not shown in the drawings), the holes of the panel 12 only allow the passage of the shafts of the gas valves 4, such that the part of the panels 12 in the area surrounding the holes and the area located behind the knobs 5 is translucent to light up the knobs 5.

The light signal source 8 of the signaling device 7 of the gas cooking appliance 1 may emit the operating and alarm signals by means of light emitters, preferably LEDs. Multicolor LEDs, for example RGB type LEDs, may be used which allows emitting any color of the spectrum with only one LED, which simplifies the assembly and even final costs. The light signal source 8 may comprise two horizontally positioned light emitters for emitting operating signal and two vertically positioned light emitters for emitting alarm signal so that the alarm and operating signals are distinguished by color, by discontinuity or by variability of the light intensity. These can be obtained with a single multicolor LED or a single LED for each light emitter. The light signal source 8 may have a variable number of light emitters depending on the lighting effects that are desired in lighting up the knob 5 or its surrounding area in the panel 12.

What is claimed is:

1. A gas cooking appliance comprising:

a gas burner, a gas regulating valve for regulating a flow of a gas to the gas burner, a position sensor operably connected to the gas regulating valve for detecting an open position or a closed position of the gas regulating valve, in the open position the gas regulating valve is configured to permit the flow of gas to the gas burner, in the closed position the gas regulating valve is configured to prevent the flow of gas to the gas burner, the position sensor configured to generate an open position signal when the gas regulating valve is in the open position and a closed position signal when the gas regulating valve is in the closed position, a flame sensor positioned adjacent the gas burner and configured to produce a flame sensor signal upon detecting a presence of a flame from the gas burner, a control module operably coupled to the position sensor and the flame sensor, the control module configured to receive the open and closed position signals from the position sensor and the flame sensor signal from the flame sensor; and a signaling device controlled by the control module, the signaling device comprising a light signal source that is capable of emitting a plurality of signals in a form of one or more lights, the control module being configured to cause the light signal source to emit a first light signal upon having received the open position signal and upon also receiving the flame sensor signal for at least a first time interval and upon subsequently not receiving the flame sensor signal while continuing to receive the open position signal from the position sensor, the first time interval being a threshold amount of time for the gas burner to reach a harmful temperature if touched by a user of the gas cooking appliance upon the gas being initially delivered to the gas burner, the control module is further configured to cause the light signal source to emit a second light signal different from the first light signal and to terminate the first light signal at a time the gas regulating valve has transitioned from the open position to the closed position, a placement of the gas regulating valve in the closed position after the first light signal is emitted causes the position sensor to send to the control module the closed position signal to cause the second light signal to be emitted.

2. A gas cooking appliance according to claim 1, wherein the signaling device further comprises a printed circuit board that transmits signals to the light signal source.

3. A gas cooking appliance according to claim 2, wherein the signaling device is arranged between the gas regulating valve and a knob coupled with the gas regulating valve, the knob adapted for controlling the opening and closing of the gas regulating valve.

4. A gas cooking appliance according to claim 3, wherein the position sensor is arranged to turn with the knob and is positioned within a housing of the signaling device.

5. A gas cooking appliance according to claim 3, wherein the signaling device further comprises a light guide arranged between the printed circuit board and the knob, the light guide being optically connected with the light signal source and adapted to direct an alarm signal from the light signal source to the knob.

6. A gas cooking appliance according to claim 3, wherein the position sensor is arranged to turn with the knob and is positioned within a housing of the signaling device.

7. A gas cooking appliance according to claim 1, wherein the light signal source comprises at least one LED.

8. A gas cooking appliance according to claim 7, wherein the at least one LED is a multicolor LED.

9. A gas cooking appliance according to claim 1, wherein the first light signal is an intermittent light signal and the second light signal is a continuous light signal.

10. A gas cooking appliance according to claim 1, wherein the first and second light signals are of a same color.

* * * * *